United States Patent [19]

Jaretsky et al.

[11] 4,236,822

[45] Dec. 2, 1980

[54] FIRE DETECTOR HOUSING

[75] Inventors: Michael G. Jaretsky, Sparta, N.J.; Michael Lax, New York, N.Y.

[73] Assignee: Baker Industries, Inc., Parsippany, N.J.

[21] Appl. No.: 5,110

[22] Filed: Jan. 22, 1979

[51] Int. Cl.[3] ..... G08B 17/10

[52] U.S. Cl. ..... 356/256; 340/628

[58] Field of Search ..... 356/437, 438, 256; 340/519, 628-630; 250/381, 385, 574; D29/6

[56] References Cited

U.S. PATENT DOCUMENTS 4,124,298 11/1978 Steele ..... 250/574 X

FOREIGN PATENT DOCUMENTS 2000282 1/1979 United Kingdom ..... 340/630

*Primary Examiner*—John K. Corbin
*Assistant Examiner*—Bruce Y. Arnold
*Attorney, Agent, or Firm*—James J. Jennings, Jr.

[57] ABSTRACT

A housing for a fire detector has a circumferential area including a series of vanes or slats, each positioned at an angle with respect to the tangent at the periphery of the housing. The angle is about 45°, which not only allows ready entrance of gases through the major portion of the "window" defined by the vanes, but also prevents particles from passing straight through the housing and out the other side. This effects good mixing of the gases, better detection of combustion particles, and also decreases the likelihood of spurious or incorrect signals due to extraneous air currents.

7 Claims, 5 Drawing Figures

FIRE DETECTOR HOUSING

BACKGROUND OF THE INVENTION

The fire detector technology has developed different systems, utilizing ionization chambers, optical arrangements, and gas sensors, for detecting the presence of particles of combustion when a fire is still in the incipient stages. Regardless of the particular sensor used, the system must have an effective housing to admit the gases with entrained particles of combustion so that the detector can operate to recognize presence of the particles. In ionization type detectors, a minute electrical current developed between two collector plates is diminished when the smoke particles enter the ionized space and impede passage of the ions. The detector can be "fooled" and provide a spurious fire signal if a gust of wind passes through the chamber and blows out the ions, diminishing the current flow to a degree which simulates the reduced current flow caused by entrance of particles of combustion. Accordingly considerable effort has been directed to providing the best possible entry of gases with the entrained particles, while attempting to minimize the possibility of too-rapid or straight-line passage through the detector to remove the ions and cause an inaccurate fire signal. Even with these considerable efforts there is substantial room for improvement in the housing characteristics.

It is therefore a primary object of the present invention to provide a smoke detector housing which has an effective "window" or particle entrance area substantially larger than those of earlier housings.

Another important object of the invention is to provide such a housing which precludes the direct-line passage of particles through the detector housing.

Yet another important object of the present invention is to provide a smoke detector housing which readily admits particles but retards their egress, to effect a rapid virtual equality of the particle density within the housing and the particle density external to the housing, to produce early detection of the fire.

SUMMARY OF THE INVENTION

A fire detector housing constructed in accordance with the present invention has a peripheral area which includes a plurality of vanes. The vanes or slats are positioned at an acute angle relative to the housing side, so that gases directed at the side of the housing are deflected by the vanes as they enter the housing. This structure not only provides an effective entrance area or "window" opening for the gases, but the angle of the vanes also prevents passage of the gases through the housing in a straight line. The combination of a substantial "window" opening with a swirling action and slow exit of the gases traps the smoke to produce an early detection of the fire, and minimizes the possibility of spurious signals.

THE DRAWING

In the drawing, like reference numerals identify like components, and in that drawing.

DETAILED DESCRIPTION OF THE INVENTION

Figure 1:
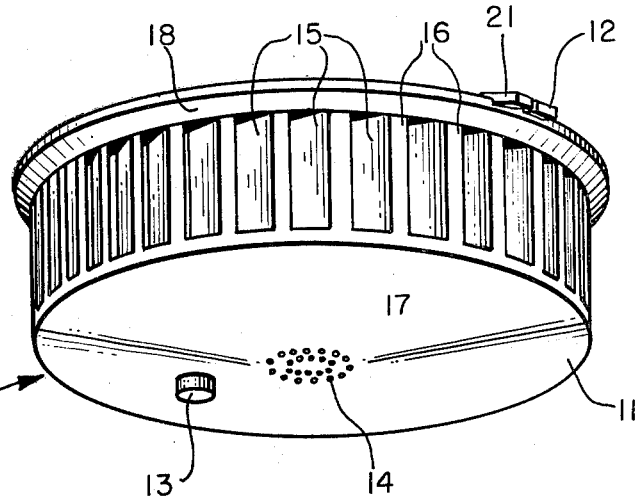
FIG. 1 is a perspective view of a smoke detector housing assembly constructed according to the present invention.

FIG. 1 shows a fire detector housing assembly 10 which includes a bowl-like component 11, and a back plate, of which only tab 12 is visible in the view of FIG. 1. The housing component 11 defines an aperture through which a test button 13 extends, and also defines a cluster of apertures 14, through which sound from a horn (not visible) is emitted under alarm conditions. Thus for practical purposes the under side of housing component 11 is virtually closed.

Particularly in accordance with the present invention, the peripheral area of the housing defines a plurality of vanes 15 which extend inwardly into the housing at an acute angle with respect to the pillars or supports 16. If a tangent were drawn to the housing adjacent the vane, the angle defined by the vane with respect to the tangent is substantially 45°, and as will be explained, this appears to give the best results. The bottom area 17 of the bowl can be considered a first support member, and the ring 18 at the other side of the vanes and pillars is in effect a second support member. As a practical matter, the entire component 11 including the relatively flat area 17, pillars 16, vanes 15 and the support ring 18, are all provided in an intergral unit in a single injection molding step using conventional plastic material such as ABS polymers.

Figure 2:
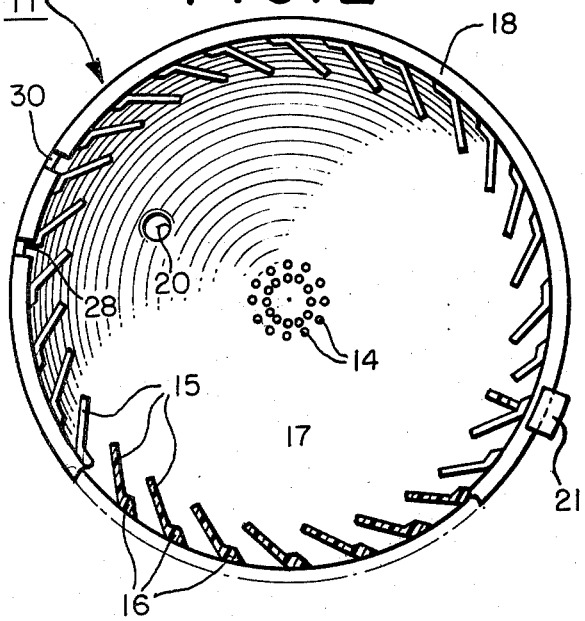
FIG. 2 is a top view of that portion of the smoke detector housing assembly which includes the vanes.

FIG. 2 is a view looking downwardly into the component 11 of the housing assembly. In this view an aperture 20 for receiving the test button is visible. The plurality of vanes or slats 15 is also evident, and the angle defined by the vanes is also apparent. From this view it is apparent that the gases with entrained particles entering the housing will be deflected and swirled around in the interior of the housing. The term "gas" or its plural "gases", as used herein and in the appended claims, includes a gas or mixture of gases with entrained particles, such as particles of combustion, whether such particles are visible or invisible.

Figure 3:
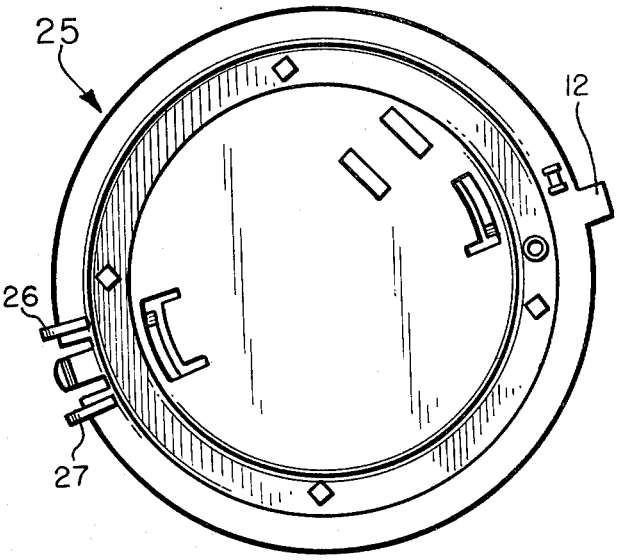
FIG. 3 is a top view of another component of the assembly housing, which mates with the portion shown in FIG. 2.

FIG. 3 is an illustrative showing of the other component 25 of the housing assembly. The component 25 includes a pair of legs 26, 27 which extend in a small arc from the component, and are received in related notches 28, 30 in the other component 11. This provides an effective hinge for mating of the two components 11 and 25, and the tabs 12 and 21 afford means for readily opening the assembly. Of course the components 11 and 25 could be replaced by a sealed unit, if desired.

Figure 5:
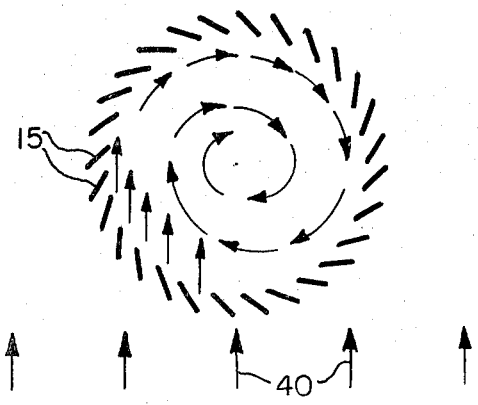
FIG. 5 is an illustrative showing of the manner in which the gases are deflected into, and swirled in, the housing.
Figure 4:
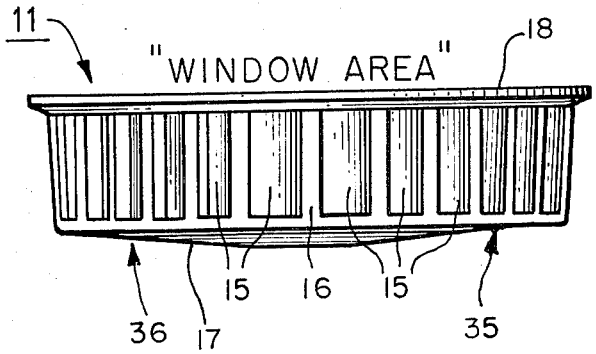
FIG. 4 is an illustrative showing of the "window" area presented by the vanes along the periphery of the housing.

FIG. 4 is an illustrative side view of the "window area" defined by the vanes 15, which is presented to gases approaching the housing assembly from the side. The gases at the left side, at the location 36, can pass directly into the housing, but cannot pass through the housing because of the angle of the vanes in the rear peripheral area. At the far right side of the window or entrance area, denoted by reference numeral 35, the angle of the vanes precludes entry of the smoke or gases. However, the acute angle insures that the gases are readily admitted over substantially more than half of the window area shown in FIG. 4. It appears that approximately 70 to 75 percent of the window area as viewed in FIG. 4 is in effect open to admit the gases. As the gases, represented by the arrows 40 in FIG. 5, approach the housing assembly, the gases pass through approximately three-fourths of the window area as represented by the arrows within the housing. The movement of the gases then becomes a swirling, circular motion in the interior of the housing, because of the angle of the vanes at the rear of the housing. Of primary importance is the fact that the construction of the invention traps smoke within the chamber, because of the swirling action and the vane arrangement. This causes the smoke density within the housing to rapidly approach and substantially equal that outside the housing, thereby leading to an early detector response and indication of the fire or combustion. The illustrated construction prevents passage of the gases directly through the chamber in a straight line, and thus minimizes the possibility of spurious triggering of the alarm circuit. In addition the good mixing achieved by the swirling gases insures that the detector will be exposed to an accurate sample, that is, will inspect a gas sample in which the particles present are in about the same proportion as in the atmosphere adjacent the detector.

While only a particular embodiment of the invention has been described and claimed herein, it is apparent that various modifications and alterations of the invention may be made. It is therefore the intention in the appended claims to cover all such modifications and alterations as may fall within the true spirit and scope of the invention.

What is claimed is:

1. A fire detector housing having a peripheral area including a plurality of vanes spaced around the peripheral area to admit gases and smoke particles into the housing, each vane being aligned at an acute angle relative to a tangent at the peripheral area, such that the vanes both provide an effective entrance area for the gases and smoke particles and prevent passage of such combustion products directly through the housng in a straight line, in which the vanes are disposed in a circular pattern, and the vanes collectively define a window area, the acute angle of the vanes ensuring that gases are readily admitted over substantially more than half the window area.

2. A fire detector housing as claimed in claim 1, in which said acute angle is substantially 45°.

3. A housing for a fire detector, comprising:

a first support member; and a plurality of vanes, disposed around the periphery of the housing in a circular pattern, with each vane being attached to the first support member and positioned at an acute angle relative to a line tangent to the location at which the vane is attached to the first support member, and the vanes collectively define a window area, the acute angle of the vanes ensuring that gases are readily admitted over substantially more than half the window area, and further ensuring that gases cannot pass directly through the detector housing in a straight line.

4. A fire detector housing as claimed in claim 3, and in which a second support member is also attached to the vanes, to enhance the structural strength of the housing.

5. A fire detector housing as claimed in claim 3, in which said acute angle is substantially 45°.

6. A housing for a fire detector, comprising:

a first support member;

a second support member;

a plurality of pillars extending between the first and second support members; and a plurality of vanes, disposed around the periphery of the housing, with each vane being attached to one of the pillars and positioned at an acute angle relative to that pillar, such that the vanes collectively define a window area, the acute angle of the vanes ensuring that gases are readily admitted over substantially more than half the window area, and further ensuring that gases cannot pass directly through the detector housing in a straight line.

7. A fire detector housing as claimed in claim 6, in which said acute angle is substantially 45°.

* * * * *